US009632442B2

(12) United States Patent
Okita et al.

(10) Patent No.: US 9,632,442 B2
(45) Date of Patent: Apr. 25, 2017

(54) ELECTROSTATIC LATENT IMAGE DEVELOPING TONER

(71) Applicant: KYOCERA Document Solutions Inc., Osaka (JP)

(72) Inventors: Masaki Okita, Osaka (JP); Yukinori Nakayama, Osaka (JP); Toshiki Takemori, Osaka (JP); Takamichi Mori, Osaka (JP); Hiroki Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/942,488

(22) Filed: Nov. 16, 2015

(65) Prior Publication Data

US 2016/0139524 A1 May 19, 2016

(30) Foreign Application Priority Data

Nov. 17, 2014 (JP) ..... 2014-232644

(51) Int. Cl.
*G03G 9/08* (2006.01)
*G03G 9/093* (2006.01)

(52) U.S. Cl.
CPC ..... *G03G 9/09371* (2013.01); *G03G 9/09314* (2013.01); *G03G 9/09378* (2013.01)

(58) Field of Classification Search
CPC ..... G03G 9/09371; G03G 9/09378; G03G 9/09314
USPC ..... 430/110.2
See application file for complete search history.

(56) References Cited

U.S. PATENT DOCUMENTS

2005/0271964 A1 12/2005 Etou et al.
2015/0004540 A1* 1/2015 Ozawa ..... G03G 9/0825 430/109.3
2015/0037724 A1* 2/2015 Mizobe ..... G03G 9/09357 430/108.22
2015/0086918 A1* 3/2015 Takemori ..... G03G 9/0821 430/108.22

FOREIGN PATENT DOCUMENTS

JP 2004-138985 A 5/2004

* cited by examiner

*Primary Examiner* — Mark A Chapman
(74) *Attorney, Agent, or Firm* — Studebaker & Brackett PC

(57) ABSTRACT

An electrostatic latent image developing toner includes toner particles that each include a toner core containing a binder resin and a shell layer disposed over a surface of the toner core. The binder resin includes a crystalline polyester resin and an amorphous polyester resin. The crystalline polyester resin has a melting point of at least 80° C. and no greater than 120° C. When the electrostatic latent image developing toner is measured using a differential scanning calorimeter, a glass transition point is observed in a first run but is not observed in a second run. The shell layer contains a resin including a thermosetting component and a thermoplastic component.

19 Claims, 4 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2014-232644, filed on Nov. 17, 2014. The contents of this application are incorporated herein by reference in their entirety.

BACKGROUND

The present disclosure relates to an electrostatic latent image developing toner.

A toner that has favorable fixability even when heating thereof by a fixing roller is kept at a minimal level is preferable in terms of energy efficiency and device miniaturization. A toner having excellent low-temperature fixability is typically prepared using a binder resin having a low melting point or glass transition point, or using a releasing agent having a low melting point. However, a toner such as described above tends to suffer from a problem of the toner particles included therein aggregating when the toner is stored at high temperatures. In a situation in which toner particles aggregate, the aggregated toner particles tend to have a lower charge than other toner particles that are not aggregated.

In consideration of the above, a toner including toner particles having a core-shell structure may be used in order to achieve an objective of obtaining a toner with excellent low-temperature fixability, improving toner high-temperature preservability, or improving toner blocking resistance. In the aforementioned core-shell structure, toner cores containing a low melting point binder resin are each coated by a shell layer formed from a resin that has a higher glass transition point than a glass transition point ($Tg^c$) of the binder resin contained in the toner cores.

In one proposed example of a toner including toner particles having a core-shell structure such as described above, the surfaces of toner cores having a softening temperature of at least 40° C. and no greater than 150° C. are coated by thin films containing a thermosetting component.

SUMMARY

An electrostatic latent image developing toner according to the present disclosure includes toner particles that each include a toner core containing a binder resin and a shell layer disposed over a surface of the toner core. The binder resin includes a crystalline polyester resin and an amorphous polyester resin. The crystalline polyester resin has a melting point of at least 80° C. and no greater than 120° C. When the electrostatic latent image developing toner is measured using a differential scanning calorimeter (DSC), a glass transition point is observed in a first run but is not observed in a second run. The shell layer contains a resin including a thermosetting component and a thermoplastic component.

DETAILED DESCRIPTION

Figure 1:
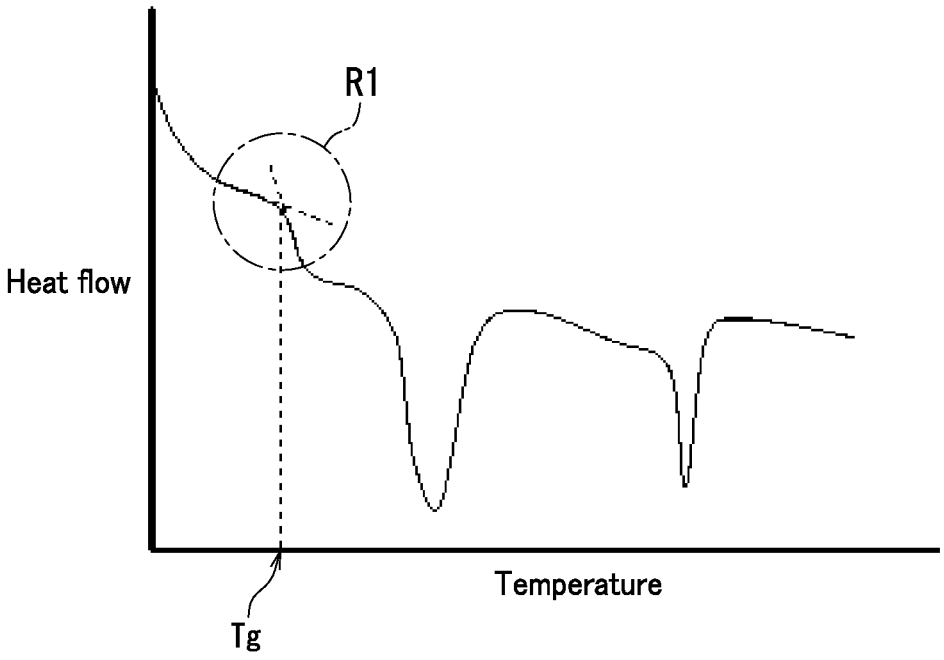
FIG. 1 illustrates a method of measuring a glass transition point (Tg) of a toner from a heat absorption curve in a first run.

The following explains an embodiment of the present disclosure. However, the present disclosure is not in any way limited by the following embodiment, and can be implemented with appropriate alterations within the intended scope of the present disclosure. Although explanation is omitted as appropriate in some instances in order to avoid repetition, such omission does not limit the essence of the present disclosure.

An electrostatic latent image developing toner (also referred to simply as a toner) according to the present embodiment is a powder including a plurality of toner particles. The toner according to the present embodiment can be used, for example, in an image forming apparatus. Unless otherwise stated, evaluation results (for example, values indicating shape and physical properties) for a powder (specific examples include toner cores, toner mother particles, external additive, and toner) are number averages of values measured for a suitable number of particles. Note that in the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Note that in the present description, the term "(meth)acryl" is used as a generic term for both acryl and methacryl.

An image forming apparatus develops an electrostatic latent image using a developer that includes a toner. Through the development, charged toner adheres to the electrostatic latent image which has been formed on a photosensitive member. After transfer of the adhered toner onto a transfer belt, a toner image on the transfer belt is transferred onto a recording medium (for example, paper). The toner is subsequently heated to fix the toner to the recording medium. Through the above process, an image is formed on the recording medium. A full-color image can be obtained by, for example, superposing toner images formed from four colors: black, yellow, magenta, and cyan.

Each of the toner particles includes a particle-shaped toner core and a shell layer disposed over the surface of the toner core. The toner cores contain a binder resin as an essential component and may further include optional components (for example, a colorant, a releasing agent, a charge control agent, or a magnetic powder) in the binder resin, depending on necessity of such optional components. The shell layers contain a resin including a thermosetting component and a thermoplastic component.

The surfaces of the toner particles (toner mother particles) may be treated with an external additive as necessary. The term "toner mother particles" is used to refer to the toner particles prior to treatment with the external additive. A plurality of shell layers may alternatively be layered on the surface of each of the toner cores.

The toner cores are preferably anionic, whereas the shell layers are preferably cationic. As a result of the toner cores being anionic, a cationic shell layer material can be attracted toward the surfaces of the toner cores during formation of the shell layers. More specifically, a toner core material that is negatively charge in an aqueous medium and a shell layer material that is positively charged in the aqueous medium are attracted toward one another, and shell layers are formed on the surfaces of toner cores through, for example, in-situ polymerization. As a result, the toner cores are not excessively dispersed in the aqueous medium through use of a dispersant, and shell layers tend to be readily formed on the surfaces of the toner cores in a uniform manner.

The binder resin is preferably a main component (for example, at least 85% by mass) of the toner cores. Consequently, polarity of the toner cores is largely influenced by polarity of the binder resin. The toner cores have a higher tendency to be anionic in a situation in which the binder resin has, for example, an ester group, a hydroxyl group, an ether group, an acid group, or a methyl group, and have a higher tendency to be cationic in a situation in which the binder resin has, for example, an amino group, an amine, or an amide group.

The toner can be used as a one component developer or can be used in a two-component developer through mixing with a desired carrier.

The toner cores of the toner particles contain the binder resin. The binder resin includes a crystalline polyester resin and an amorphous polyester resin. As explained further below, each of the toner cores is coated with a shell layer containing a resin that includes a thermosetting component and a thermoplastic component. Therefore, the binder resin is preferably a resin that has at least one functional group selected from the group consisting of a hydroxyl group, a carboxyl group, and an amino group in molecules thereof, and more preferably a resin that includes either or both of a hydroxyl group and a carboxyl group in molecules thereof. A resin such as described above reacts with a thermosetting component such as methylol melamine to form covalent bonds. Therefore, a binder resin such as described above can be used in order to prepare a toner in which shell layers and toner cores are strongly bound to one another.

In addition, as a result of the toner particles having a structure that is protected by hard shell layers containing a thermosetting component, the toner particles tend not to rupture when subjected to stress over a long period of time in a developing device. Furthermore, the shell layers are strongly bound to the toner cores and tend not to detach from the toner cores. Therefore, the toner according to the present embodiment has excellent high-temperature preservability.

Figure 2:
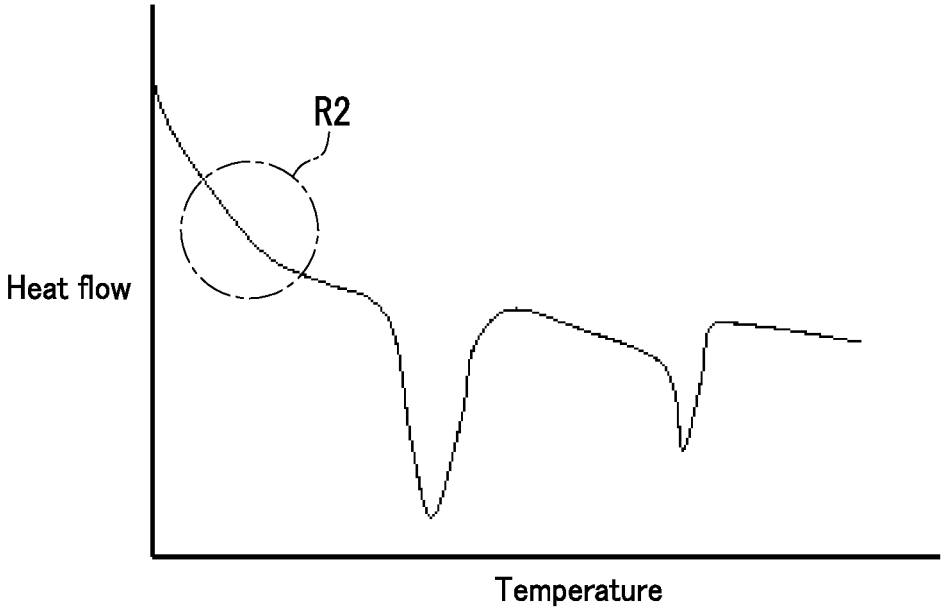
FIG. 2 illustrates a method of measuring a glass transition point (Tg) of a toner from a heat absorption curve in a second run.

When the toner according to the present disclosure containing the crystalline polyester resin is measured using a differential scanning calorimeter, a glass transition point (Tg) of the toner is observed in a first run but is not observed in a second run. A method of reading the glass transition point (Tg) is explained with reference to FIGS. 1 and 2. FIG. 1 illustrates a heat absorption curve of the toner in the first run. FIG. 2 illustrates a heat absorption curve of the toner in the second run. In each of FIGS. 1 and 2, the vertical axis represents heat flow and the horizontal axis represents temperature. Specifically, at least 5 mg and no greater than 20 mg of the toner is added into an aluminum pan that is set in a measurement section of the differential scanning calorimeter. Next a first run is performed starting from a measurement temperature of at least 5° C. and no greater than 20° C. and heating at a rate of at least 5° C./minute and no greater than 20° C./minute to a temperature of at least 100° C. and no greater than 200° C. Next, cooling to a temperature of at least 5° C. and no greater than 20° C. is performed at a rate of at least 5° C./minute and no greater than 20° C./minute. A second run is subsequently performed by reheating at a rate of at least 5° C./minute and no greater than 20° C./minute to a temperature of at least 100° C. and no greater than 200° C. Heat absorption curves such as illustrated in FIGS. 1 and 2 are obtained through the above measurements.

A glass transition point of a toner is indicated by a point of change of specific heat on a heat absorption curve obtained using a differential scanning calorimeter. For the toner according to the present embodiment, a glass transition point (Tg) can be observed in the first run because there is a change in gradient (specific heat) of the heat absorption curve in a region R1 as illustrated in FIG. 1. In contrast, the gradient (specific heat) of the heat absorption curve in the second run hardly changes in a region R2 as illustrated in FIG. 2. Therefore, the glass transition point (Tg) of the toner cannot be observed in the second run. The reason that the glass transition point (Tg) of the toner is not observed for the heat absorption curve in the second run is thought to be due to low crystallinity of the crystalline polyester resin contained in the toner.

A toner that contains a crystalline polyester resin having high crystallinity tends to give similar heat absorption curves in both a first run and a second run. In such a situation, a glass transition point (Tg) can also be observed in the second run. In contrast, for the toner according to the present embodiment, the glass transition point (Tg) can be observed in the first run but cannot be observed in the second run. In the above situation, the toner has excellent low-temperature fixability. The reason for the above is that the crystalline polyester resin contained in the toner cores does not have high crystallinity and thus is more compatible with the amorphous polyester resin contained in the toner cores.

The toner according to the present embodiment has excellent low-temperature fixability because the toner contains the binder resin including the crystalline polyester resin. The following explains the crystalline polyester resin and the amorphous polyester resin in order.

The crystalline polyester resin is obtained through polycondensation or condensation copolymerization of an alcohol component and a carboxylic acid component. A di-, tri-, or higher-hydric alcohol can be used as the alcohol component. Specific examples of di-hydric alcohol components that can be used include diols (for example, ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, or polytetramethylene glycol) and bisphenols (for example, bisphenol A, hydrogenated bisphenol A, polyoxyethylene bisphenol A ether, or polyoxypropylene bisphenol A ether).

Specific examples of tri- or higher-hydric alcohol components that can be used include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Among the alcohol components listed above, aliphatic diols having a carbon number of 2-8 are preferable and α,ω-alkanediols having a carbon number of 2-8 are more preferable in terms of promoting crystallization of the polyester resin.

In order to obtain a crystalline polyester resin, the alcohol component preferably consists of at least 80 mol % of one or more aliphatic diols having a carbon number of 2-10, and more preferably at least 90 mol %. Likewise, a component (single compound) having a largest content in the alcohol component preferably has a content of at least 70 mol %, more preferably at least 90 mol %, and most preferably 100 mol %.

A di-, tri-, or higher-basic carboxylic acid can be used as the carboxylic acid component. Specific examples of dibasic carboxylic acid components that can be used include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids (for example, n-butylsuccinic acid, isobutylsuccinic acid, n-octylsuccinic acid, n-dodecylsuccinic acid, or isododecylsuccinic acid), and alkenyl succinic acids (for example, n-butenylsuccinic acid, isobutenylsuccinic acid, n-octenylsuccinic acid, n-dodecenylsuccinic acid, or isododecenylsuccinic acid).

Specific examples of tri- or higher-basic carboxylic acid components that can be used include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid. Alternatively, an ester forming derivative of any of the di-, tri-, or higher-basic carboxylic acid components listed above may be used (for example, an acid halide, an acid anhydride, or a lower alkyl ester). Herein, the term "lower alkyl" refers to an alkyl group that has a carbon number of 1-6.

Among the carboxylic acid components listed above, aliphatic dicarboxylic acids having a carbon number of 2-16 are preferable and α,ω-alkanedicarboxylic acids having a carbon number of 2-16 are more preferable in terms of promoting crystallization of the polyester resin.

In order to obtain a crystalline polyester resin, the carboxylic acid component preferably consists of at least 70 mol % of one or more aliphatic dicarboxylic acids having a carbon number of 2-16, and more preferably at least 90 mol %. Likewise, a component (single compound) having a largest content in the carboxylic acid component preferably has a content of at least 70 mol %, more preferably at least 90 mol %, and most preferably 100 mol %.

The crystalline polyester resin is a polyester resin that has a crystallinity index of at least 0.90 and less than 1.10, and preferably at least 0.98 and no greater than 1.05.

The crystallinity index of the crystalline polyester resin can be obtained from a ratio ($Tm/Mp^c$) of a softening point (Tm) and a melting point (peak indicating maximum heat absorption on a heat absorption curve, $Mp^c$) of the crystalline polyester resin. The softening point (Tm) can be measured according to the following method. Note that the crystallinity index of a polyester resin can be appropriately adjusted through the type and amount of an alcohol component or a carboxylic acid component used as a monomer. A single type of crystalline polyester resin may be used or a combination of two or more types of crystalline polyester resins may be used.

Figure 3:
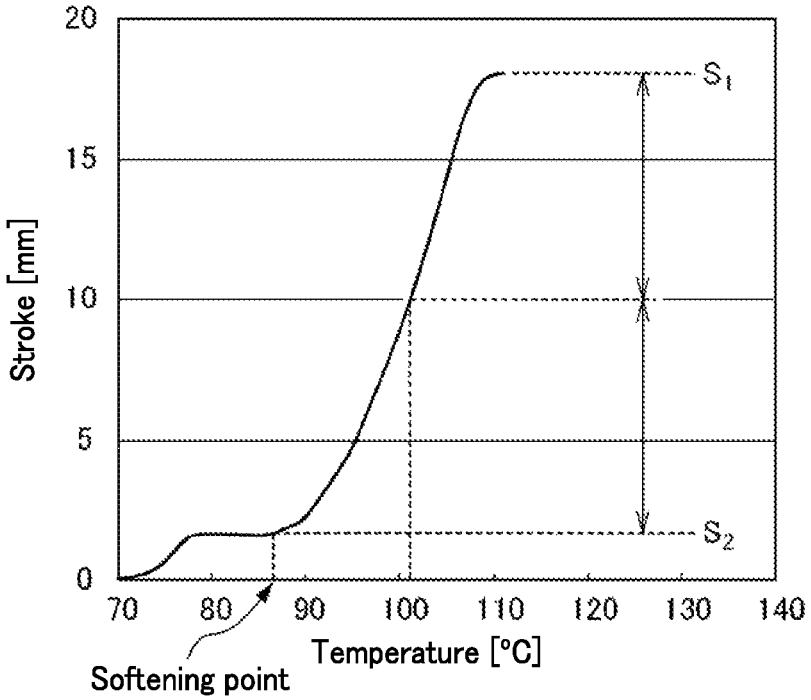
FIG. 3 illustrates a method of reading a softening point (Tm) of a crystalline polyester resin.

The softening point (Tm) of the crystalline polyester resin is measured using a capillary rheometer (for example, CFT-500D produced by Shimadzu Corporation). A measurement sample (crystalline polyester resin) is set in the capillary rheometer and an S-shaped curve (S-shaped curve of stroke (mm)/temperature (° C.)) such as illustrated in FIG. 3 is obtained by causing melt-flow of 1 $cm^3$ of the sample under conditions of a die diameter of 1 mm, a plunger load of 20 $kg/cm^2$, and a heating rate of 6° C./minute. The softening point (Tm) is a temperature corresponding to a first shoulder part of the S-shaped curve.

Although no particular limitations are placed on the softening point (Tm) of the crystalline polyester resin, the softening point (Tm) is preferably at least 70° C. and no greater than 100° C. In a situation in which a plurality of different types of crystalline polyester resins is used, the softening point (Tm) is that of a resin resulting from uniform melt-kneading of the crystalline polyester resins.

The crystalline polyester resin according to the present disclosure does not readily crystallize in the toner; in other words, the crystalline polyester resin according to the present disclosure is highly compatible with the amorphous polyester resin. Typically, how to cause crystallization of a crystalline polyester resin in a toner in order to achieve both heat resistance and preservability is an important issue. However, sufficient preservability is ensured in the present disclosure through the shell layers containing the thermosetting component and the thermoplastic component. Therefore, easy crystallization is not required and a low melting point can be prioritized instead in material selection. The ease of crystallization in the toner can be confirmed through differential scanning calorimetry.

Figure 4:
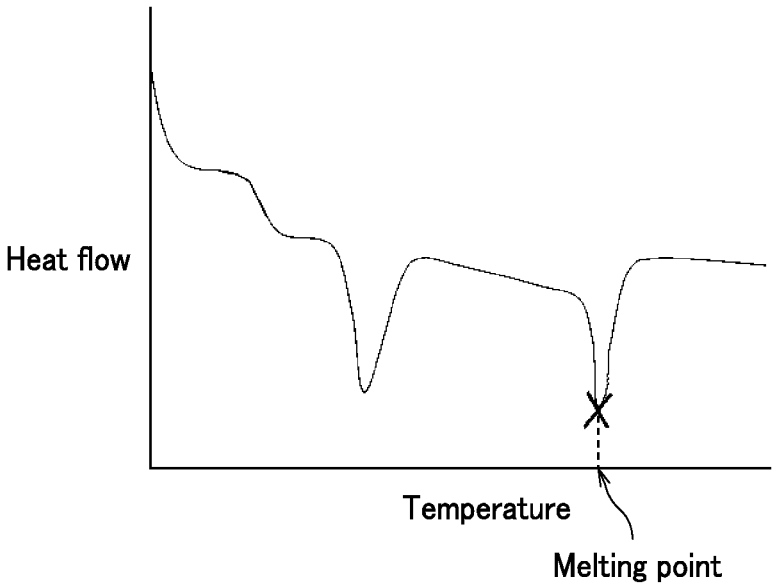
FIG. 4 illustrates a method of measuring a melting point ($Mp^c$) of a crystalline polyester resin from a heat absorption curve.

A method of obtaining the melting point ($Mp^c$) of the crystalline polyester resin is explained with reference to FIG. 4. The melting point ($Mp^c$) of the crystalline polyester resin can for example be measured using a differential scanning calorimeter (DSC-6220 produced by Seiko Instruments Inc.). Specifically, an aluminum pan containing at least 10 mg and no greater than 20 mg of the crystalline polyester resin is set in a measurement section of the differential scanning calorimeter. An empty aluminum pan is used as a reference. Heating is performed from 10° C. to 150° C. at a rate of 10° C./minute. A heat absorption curve such as illustrated in FIG. 4 is obtained through the above measurement. The melting point ($Mp^c$) of the crystalline polyester resin is the temperature of a peak corresponding to a maximum of heat of fusion on the heat absorption curve.

The melting point ($Mp^c$) of the crystalline polyester resin is at least 80° C. and no greater than 120° C. The toner including the crystalline polyester resin having the melting point ($Mp^c$) of at least 80° C. and no greater than 120° C. has excellent high-temperature preservability and low-temperature fixability, and can also inhibit occurrence of offset at high temperatures. More specifically, a toner including a crystalline polyester resin having a melting point ($Mp^c$) that is too low (less than 80° C.) tends deform under high temperature conditions and tends to adhere to a fixing roller when fixing is performed at high temperatures. Therefore, such a toner has poor high-temperature preservability and cannot inhibit occurrence of offset at high temperatures. In a toner that includes toner particles prepared using toner cores including a crystalline polyester resin having a melting point ($Mp^c$) that is too high (greater than 120° C.), the toner cores tend not to melt during fixing of the toner to a recording medium and thus the toner has poor low-temperature fixability.

A single type of amorphous polyester resin may be used or a combination of two or more types of amorphous polyester resins may be used. A crystallinity index of the amorphous polyester resin can be measured according to the same method as the crystallinity index of the crystalline polyester resin. The amorphous polyester resin has a crystallinity index of at least 1.10 and no greater than 4.00, and preferably at least 1.50 and no greater than 3.00.

In order to prepare the amorphous polyester resin, it is necessary to inhibit crystallization of an obtained polyester resin. Although no particular limitations are placed on the method by which crystallization of the polyester resin is inhibited, the following methods (1) to (3) are provided as examples of common methods used for inhibiting crystallization.

(1) Alcohol components and carboxylic acid components described above that promote crystallization are not used or are only used in small amounts.

(2) At least two types of compounds are used as the alcohol component and the carboxylic acid component.

(3) An alcohol component such as a bisphenol A-alkylene oxide adduct or a carboxylic acid component such as alkyl-substituted succinic acid is used.

Among the methods described above for inhibiting crystallization, method (3) is preferable in terms that an amorphous polyester resin can be easily prepared through a small number of different types of monomers. In method (3), increasing the amount of the alcohol component (for example, bisphenol A-alkylene oxide adduct) and the carboxylic acid component (for example, alkyl-substituted succinic acid) tends to further inhibit crystallization. However, the amounts of such monomers are preferably adjusted as appropriate in consideration of the crystallinity index and other physical properties of the polyester resin to be obtained. A single type of amorphous polyester resin may be used or a combination of two or more types of amorphous polyester resins may be used.

Although no particular limitations are placed on the glass transition point ($Tg^{nc}$) of the amorphous polyester resin, the glass transition point ($Tg^{nc}$) is preferably at least 50° C. and no greater than 70° C., and more preferably at least 60° C. and no greater than 65° C. In a situation in which a plurality of different types of amorphous polyester resins is used, the glass transition point ($Tg^{nc}$) of the amorphous polyester resin is that of a resin obtained through melt-kneading of the plurality of amorphous polyester resins. The glass transition point ($Tg^{nc}$) of the amorphous polyester resin can be measured using a differential scanning calorimeter according to the same method as the melting point ($Mp^{c}$).

In order to improve core strength and toner fixability, the amorphous polyester resin preferably has a mass average molecular weight (Mw) of at least 39,000 and no greater than 58,000. The amorphous polyester resin preferably has a molecular weight distribution (Mw/Mn) of at least 8 and no greater than 50. Herein, the molecular weight distribution (Mw/Mn) expresses a ratio of the mass average molecular weight (Mw) of the amorphous polyester resin relative to a number average molecular weight (Mn) of the amorphous polyester resin. The mass average molecular weight (Mw) and the number average molecular weight (Mn) of the amorphous polyester resin can be measured by gel permeation chromatography.

In order to ensure sufficient anionic strength, the amorphous polyester resin preferably has an acid value of at least 5 mg KOH/g and no greater than 30 mg KOH/g. For the same reason, the amorphous polyester resin preferably has a hydroxyl value of at least 15 mg KOH/g and no greater than 80 mg KOH/g.

The acid value and the hydroxyl value of the amorphous polyester resin can be adjusted by adjusting the amounts of the alcohol component and the carboxylic acid component used in preparation of the amorphous polyester resin. An increase in molecular weight of the amorphous polyester resin tends to result in a decrease in the acid value and the hydroxyl value of the amorphous polyester resin.

In order to achieve excellent high-temperature preservability and low-temperature fixability, and to inhibit occurrence of offset at high temperatures, a ratio (P/Q, mass ratio) of a content of the crystalline polyester resin (P) relative to a content of the amorphous polyester resin (Q) is preferably at least 0.01 and no greater than 1.

The binder resin may optionally include another thermoplastic resin (referred to below as an additional thermoplastic resin) that differs from the crystalline polyester resin and the amorphous polyester resin. The additional thermoplastic resin is appropriately selected from among thermoplastic resins that can be used as a binder resin of a toner.

The content (P) of the crystalline polyester resin and the content (Q) of the amorphous polyester resin in the binder resin preferably have a total value of at least 70% by mass, more preferably at least 80% by mass, particularly preferably at least 90% by mass, and most preferably 100% by mass.

A known pigment or dye matching a color of the toner particles can be used as a colorant. The following provides specific examples of preferable colorants. The amount of the colorant is preferably at least 1 part by mass and no greater than 30 parts by mass relative to 100 parts by mass of the binder resin.

Carbon black can for example be used as a black colorant. Alternatively, a colorant that is adjusted to a black color using a yellow colorant, a magenta colorant, and a cyan colorant explained below can for example be used as a black colorant.

In the case of toner particles of a color toner, a yellow colorant, a magenta colorant, or a cyan colorant can for example be used as a colorant.

Examples of yellow colorants that can be used include condensed azo compounds, isoindolinone compounds, anthraquinone compounds, azo metal complexes, methine compounds, and arylamide compounds. Specific examples include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include copper phthalocyanine compounds, anthraquinone compounds, and basic dye lake compounds. Specific examples include C.I. Pigment Blue (1, 7, 15, 15:1, 15:2, 15:3, 15:4, 60, 62, or 66), Phthalocyanine Blue, C.I. Vat Blue, and C.I. Acid Blue.

A releasing agent is used in order to improve fixability or offset resistance of the toner. The amount of the releasing agent is preferably at least 1 part by mass and no greater than 30 parts by mass relative to 100 parts by mass of the binder resin, and more preferably at least 5 parts by mass and no greater than 20 parts by mass.

The releasing agent is preferably a wax. Examples of waxes that can be used include ester wax, polyethylene wax, polypropylene wax, fluororesin-based wax, Fischer-Tropsch wax, paraffin wax, and montan wax. Among the releasing agents listed above, ester wax is preferable. The ester wax is for example a synthetic ester wax or a natural ester wax (carnauba wax or rice wax). A synthetic ester wax is preferable because it is easy to adjust a melting point (Mp′) of the releasing agent to within a preferable range explained below through appropriate selection of synthetic raw materials. A combination of two or more of the releasing agents listed above can be used. The melting point (Mp′) of the releasing agent can be measured using a differential scanning calorimeter.

So long as the synthetic ester wax is prepared by a chemical synthetic method, no particular limitations are placed on the method by which the synthetic ester wax is prepared. The synthetic ester wax can for example be prepared according a known method (through a reaction of an alcohol and a carboxylic acid or a reaction of a carboxylic acid halide and an alcohol in the presence of an acid catalyst). The raw materials of the synthetic ester wax may for example be derived from natural products (for example, a long-chain fatty acid produced from a natural oil or fat) or may be commercially available synthetic products.

The melting point (Mp′) of the releasing agent is preferably at least 50° C. and no greater than 80° C. The melting point (Mp′) of the releasing agent is the temperature of a peak indicating maximum heat absorption on a heat absorption curve measured using a differential scanning calorimeter. A toner including a releasing agent having a melting point (Mp′) of at least 50° C. and no greater than 80° C. has excellent low-temperature fixability and can inhibit occurrence of offset at high temperatures.

A charge control agent may be included in the toner cores or the shell layers in order to adjust the acid value of the binder resin in the toner cores or in order to adjust the chargeability of the shell layers.

The toner cores may contain a magnetic powder in the binder resin depending on necessity thereof. A toner including toner particles that include toner cores containing a magnetic powder is used as a magnetic one component developer. Examples of preferable magnetic powders include iron (for example, ferrite or magnetite), ferromagnetic metals (for example, cobalt or nickel), alloys including either or both of iron and a ferromagnetic metal, compounds including either or both of iron and a ferromagnetic metal, ferromagnetic alloys subjected to ferromagnetization such as heat treatment, and chromium dioxide.

The magnetic powder preferably has a particle size of at least 0.1 μm and no greater than 1.0 μm, and more preferably at least 0.1 μm and no greater than 0.5 μm. A magnetic powder having a particle size in the aforementioned range tends to be easy to disperse uniformly in the binder resin.

The amount of the magnetic powder in a situation in which the toner is used as a one component developer is preferably at least 35 parts by mass and no greater than 60 parts by mass relative to 100 parts by mass of the toner overall, and more preferably at least 40 parts by mass and no greater than 60 parts by mass. The amount of the magnetic powder in a situation in which the toner is used in a two component developer is preferably no greater than 20 parts by mass relative to 100 parts by mass of the toner overall, and more preferably no greater than 15 parts by mass.

The resin forming the shell layers includes a thermosetting component and a thermoplastic component.

The thermoplastic component of the resin forming the shell layers may be cross-linked by the thermosetting component. In such a situation, the shell layers have appropriate flexibility based on the thermoplastic component and have appropriate mechanical strength based on a three dimensional cross-linking structure formed by the thermosetting component. Therefore, a toner including toner particles including shell layers such as described above has excellent high-temperature preservability and low-temperature fixability. More specifically, the shell layers tend not to rupture during storage or transportation. On the other hand, during fixing, the shell layers tend to readily rupture upon application of heat and pressure and the toner cores rapidly soften or melt. Therefore, the toner can be fixed to a recording medium at low temperatures.

Note that the thermoplastic component may include a unit that is altered, for example by introduction of a functional group, oxidation, reduction, or substitution of atoms, without drastically changing the structure or properties of the base thermoplastic component. Note that the thermosetting component may include a unit that is altered, for example by introduction of a functional group, oxidation, reduction, or substitution of atoms, without drastically changing the structure or properties of the base thermosetting component.

A monomer used to introduce the thermosetting component into the resin is preferably a monomer or prepolymer for formation of at least one thermosetting resin selected from the group consisting of a melamine resin, a urea resin, and a glyoxal resin.

The melamine resin is a polycondensate of melamine and formaldehyde. Therefore, melamine is a monomer for formation of the melamine resin. The urea resin is a polycondensate of urea and formaldehyde. Therefore, urea is a monomer for formation of the urea resin. The glyoxal resin is a polycondensate of formaldehyde and a reaction product of glyoxal and urea. Therefore, the reaction product of glyoxal and urea is a monomer for formation of the glyoxal resin. The melamine, the urea, or the urea caused to react with the glyoxal may be modified in a known manner. The monomer used to introduce the thermosetting component into the resin may be used in the form of a derivative that is methylolated by formaldehyde prior to shell layer formation.

The shell layers preferably contain nitrogen atoms that originate from melamine, urea, or glyoxal. As a result, the toner according to the present embodiment, which includes the shell layers containing nitrogen atoms, tends to be easy to positively charge. Therefore, in a situation in which the toner according to the present embodiment is positively charged for image formation, it is easy to positively charge the toner particles in the toner to a desired charge. In order that the toner particles in the toner are easy to positively charge to a desired charge, the amount of nitrogen atoms in the shell layers is preferably at least 10% by mass.

The thermoplastic component preferably has a functional group that is reactive with a functional group of the thermosetting component. For example, the thermoplastic component preferably has a functional group including an active hydrogen atom (for example, a hydroxyl group, a carboxyl group, or an amino group). The amino group may be included in the thermoplastic component in the form of a carbamoyl group (—$CONH_2$). In order to facilitate shell layer formation, the monomer used to introduce the thermoplastic component into the resin is preferably (meth)acryl amide or a monomer for formation of a thermoplastic resin having a carbodiimide group, an oxazoline group, or a glycidyl group.

Specific examples of the monomer used to introduce the thermoplastic component into the resin include monomers for formation of acrylic acid-based resins, styrene-acrylic acid-based copolymer resins, silicone-(meth)acrylic acid-based graft copolymers, urethane resins, polyester resins, polyvinyl alcohols, and ethylene vinyl alcohol copolymers. The monomer used to introduce the thermoplastic component into the resin may for example have a carbodiimide group, an oxazoline group, or a glycidyl group. Among the monomers listed above, the monomer used to introduce the thermoplastic component into the resin is preferably a monomer for formation of an acrylic acid-based resin, a styrene-acrylic acid-based copolymer resin, or a silicone-(meth)acrylic acid-based graft copolymer, with a monomer for formation of an acrylic acid-based resin being particularly preferable.

Examples of acrylic acid-based monomers that can be used for formation of an acrylic acid-based resin include (meth)acrylic acid, alkyl (meth)acrylates (for example, methyl (meth)acrylate, ethyl (meth)acrylate, n-propyl (meth)acrylate, or n-butyl (meth)acrylate), aryl (meth)acrylates (for example, phenyl (meth)acrylate), hydroxyalkyl (meth)acrylates (for example, 2-hydroxyethyl (meth)acrylate, 3-hydroxyproyl (meth)acrylate, 2-hydroxypropyl (meth)acrylate, or 4-hydroxybutyl (meth)acrylate), (meth) acrylamide, ethylene oxide adduct of (meth)acrylic acid, and alkyl ethers (for example, methyl ether, ethyl ether, n-propyl ether, or n-butyl ether of ethylene oxide adduct of (meth) acrylic acid ester).

Shell layer formation is preferably performed in an aqueous medium in order that the binder resin does not dissolve and in order that a releasing agent component of the toner cores does not elute. Therefore, the monomer used to introduce the thermoplastic component into the resin, which is used in shell layer formation, is preferably water-soluble and is particularly preferably used as an aqueous solution containing the monomer used to introduce the thermoplastic component into the resin.

The shell layers preferably have a thickness of at least 1 nm and no greater than 20 nm, and more preferably at least 1 nm and no greater than 10 nm. If the shell layers are too thick, the shell layers tend not to rupture even when pressure is applied during fixing of the toner to a recording medium. In such a situation, softening or melting of the binder resin and the releasing agent contained in the toner cores does not proceed rapidly, thereby making it difficult to fix the toner to the recording medium in a low temperature region. On the other hand, if the shell layers are too thin, the shell layers are weak and may rupture due to impact, for example during transportation. In a situation in which the toner is stored at a high temperature, toner particles including shell layers that have at least partially ruptured tend to aggregate. The reason for the above is that at high temperatures, components such as the releasing agent tend to exude to the surface of the toner particles through ruptured parts of the shell layers.

The thickness of the shell layers can be measured through analysis of cross-sectional TEM images of the toner particles using commercially available image analysis software. The commercially available image analysis software is for example WinROOF (produced by Mitani Corporation). More specifically, two straight lines that perpendicularly intersect at approximately the center of a cross-section of a measurement target toner particle are drawn and lengths of four segments where the two straight lines intersect the shell layer are measured. The thickness of the shell layer of the measurement target toner particle is taken to be an average value of the measured lengths of the four segments. Such shell layer thickness measurement is performed for at least 10 toner particles to obtain an average value of shell layer film thickness for the measurement target toner particles. The average value is taken to be the film thickness of the shell layers of the toner particles.

In a situation in which the shell layer is too thin, it may be difficult to measure the thickness of the shell layer due to an interface between the shell layer and the toner core being unclear in a TEM image. In such a situation, the thickness of the shell layer can be measured using a combination of TEM imaging and energy dispersive X-ray spectroscopic analysis (EDX) to perform mapping in a TEM image of an element that is characteristic of a material of the shell layer (for example, nitrogen) in order to clarify the interface between the shell layer and the toner core.

The thickness of the shell layers can be adjusted by adjusting the amounts of materials (thermosetting component and thermoplastic component) used to form the shell layers.

An external additive may be caused to adhere to the surfaces of the toner particles depending on necessity thereof. Examples of external additives that can be used include fine particles of silica and metal oxides (for example, alumina, titanium oxide, magnesium oxide, zinc oxide, strontium titanate, and barium titanate).

The external additive preferably has a particle size of at least 0.01 μm and no greater than 1.0 μm. The amount of the external additive is preferably at least 1 part by mass and no greater than 10 parts by mass relative to 100 parts by mass of the toner mother particles, and more preferably at least 2 parts by mass and no greater than 5 parts by mass.

The toner according to the present embodiment can be used in a two-component developer by mixing the toner with a desired carrier. The two-component developer is preferably prepared using a magnetic carrier.

In one example of a preferable carrier, carrier cores are coated with a resin. Specific examples of the carrier cores include: particles of iron, oxidized iron, reduced iron, magnetite, copper, silicon steel, ferrite, nickel, or cobalt; particles of an alloy of any of the above materials with a metal such as manganese, zinc or aluminum; particles of iron-nickel alloy or iron-cobalt alloy; particles of a ceramic (titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate); particles of a high-dielectric substance (ammonium dihydrogen phosphate, potassium dihydrogen phosphate, or Rochelle salt); and a resin carrier in which any of the above types of particles are dispersed in a resin.

Examples of the resin coating the carrier cores include acrylic acid-based polymers, styrene-based polymers, styrene-acrylic acid-based copolymers, olefin-based polymers (polyethylene, chlorinated polyethylene, or polypropylene), polyvinyl chloride, polyvinyl acetate, polycarbonate resins, cellulose resins, polyester resins, unsaturated polyester resins, polyamide resins, urethane resins, epoxy resins, silicone resins, fluororesins (polytetrafluoroethylene, polychlorotrifluoroethylene, or polyvinylidene fluoride), phenolic resins, xylene resins, diallyl phthalate resins, polyacetal resins, and amino resins. A combination of two or more types of the resins listed above can be used.

The carrier preferably has a particle size of at least 20 μm and no greater than 120 μm, and more preferably at least 25 μm and no greater than 80 μm, as measured using an electron microscope.

In a situation in which the toner is used in a two component developer, the amount of the toner is preferably at least 3% by mass and no greater than 20% by mass relative to the mass of the two component developer, and more preferably at least 5% by mass and no greater than 15% by mass.

[Toner Production Method]

No particular limitations are placed on the method by which the toner is produced so long as the method enables coating of toner cores with shell layers made from the materials specified above. The following explains a preferable example of a method for producing the electrostatic latent image developing toner according to the present embodiment. The production method includes a process of producing toner cores (toner core production process) and a process of forming shell layers on the surfaces of the toner cores (shell layer formation process).

No particular limitations are placed on the toner core production process so long as the process enables favorable dispersion of optional components (components such as a colorant, a charge control agent, a releasing agent, or a magnetic powder) in a binder resin; a known method may be adopted as appropriate. The toner core production process may for example be carried out by a pulverization method or an aggregation method.

The pulverization method involves mixing (mixing step) a binder resin and optional components (a colorant, a releasing agent, a charge control agent, or a magnetic powder), melt-kneading (melt-kneading step) the resultant mixture, pulverizing (pulverizing step) the resultant melt-knead, and classifying (classifying step) the pulverized product to yield toner cores of a desired particle size. It is relatively easy to prepare the toner cores through the pulverization method. Unfortunately, as a result of the toner cores undergoing the pulverizing step, it is more difficult to obtain toner cores having high roundness than compared to the aggregation method. However, in the shell layer formation process described further below, the toner cores are spheroidized due to contraction of the toner cores by surface tension or softening of the toner cores prior to a curing reaction of the shell layers. Therefore, although roundness of the toner cores may be decreased slightly, such a decrease is not a major disadvantage in production of the toner according to the present embodiment.

The aggregation method includes, for example, an aggregation step and a coalescence step. The aggregation step involves causing fine particles including toner core components to aggregate in an aqueous medium to form aggregated particles. The coalescence step involves causing the components included in the aggregated particles to coalesce in the aqueous medium to form toner cores. In a situation in which the toner cores are produced using the aggregation method, it tends to be easier to obtain toner cores that are uniform in terms of shape and particle size.

Triboelectric charge of the toner cores is preferably of negative polarity, and is more preferably no greater than −10 μC/g. The following explains a method for measuring the triboelectric charge. The toner cores are mixed for 30 minutes with a standard carrier (standard carrier for negative-charging toner N-01) provided by The Imaging Society of Japan using a TURBULA mixer. The amount of the toner cores is 7% by mass relative to the mass of the standard carrier. After mixing, the triboelectric charge of the toner cores is measured using a Q/m meter (MODEL 210HS-2A produced by Trek, Inc.). The triboelectric charge of the toner cores, measured as described above, indicates whether the toner cores tend to be charged to positive or negative polarity and indicates how readily the toner cores are charged.

Zeta potential of the toner cores measured in an aqueous medium adjusted to pH 4 is preferably of negative polarity, and is more preferably no greater than −10 mV. The following explains a method of measuring zeta potential in a pH 4 dispersion. A magnetic stirrer is used to mix 0.2 g of the toner cores, 80 mL of ion exchanged water, and 20 g of a non-ionic surfactant (polyvinylpyrrolidone, K-85 produced by Nippon Shokubai Co., Ltd., concentration 1% by mass) in order to obtain a dispersion in which the toner cores are uniformly dispersed in a solvent. Next, the dispersion is adjusted to pH 4 through addition of dilute hydrochloric acid. The resultant dispersion is used as a measurement sample for measuring the zeta potential of the toner cores in the dispersion using a zeta potential and particle size distribution analyzer (Delsa Nano HC produced by Beckman Coulter, Inc.).

In order to form uniform shell layers on the surfaces of toner cores, it is usually necessary to sufficiently disperse the toner cores in an aqueous medium including a dispersant. However, in the case of toner cores that have a triboelectric charge with the standard carrier in the specified range, as measured under the conditions described above, the toner cores and the thermosetting component are electrically attracted toward one another in the aqueous medium. Note that the thermosetting component is a nitrogen-containing compound that is positively charged in the aqueous medium. Furthermore, a reaction of the thermosetting component and the thermoplastic component adhering to the toner cores proceeds favorably at the surfaces of the toner cores. Therefore, uniform shell layers can be formed without using a dispersant. A dispersant tends to have an extremely high effluent load. Therefore, as a result of a dispersant not being used in production of the toner particles, the total organic carbon concentration of discharged effluent can be kept at a low level of no greater than 15 mg/L without dilution of the effluent.

In the case of toner cores that have a zeta potential in a pH 4 aqueous medium within the specified range, the same effects as described above can be achieved in formation of shell layers on the surfaces of toner cores in the aqueous medium.

In the shell layer formation process, shell layers are formed such as to coat the toner cores. The shell layers are preferably formed using the thermoplastic component and melamine, urea, a reaction product of glyoxal and urea, or a precursor (methylolated compound) produced through an addition reaction of formaldehyde with melamine, urea, or the reaction product of glyoxal and urea. Shell layer formation is preferably carried out in a solvent such as water in order to prevent dissolution of the binder resin in the solvent and in order to prevent elution of the releasing agent contained in the toner cores.

Shell layer formation is preferably carried out by adding shell layer materials into an aqueous dispersion containing the toner cores. Examples of methods for favorably dispersing the toner cores in an aqueous medium include a method that involves using a device capable of vigorous stirring of a dispersion (for example, a HIVIS MIX produced by PRIMIX Corporation) to mechanically disperse the toner cores in an aqueous medium, and a method that involves dispersing the toner cores in an aqueous medium containing a dispersant.

The aqueous dispersion is preferably adjusted to approximately pH 4 using an acidic substance prior to addition of the shell layer materials. Adjusting the dispersion to an acidic pH promotes a polycondensation reaction of the shell layer materials described further below.

After the pH of the aqueous dispersion is adjusted, the toner cores and the shell layer materials are mixed in the aqueous medium as necessary. Next, a reaction of the shell layer materials in the aqueous medium is caused to occur at the surfaces of the toner cores in order to form shell layers that coat the surfaces of the toner cores.

In order that shell layer formation proceeds favorably, the temperature during formation of the shell layers on the surfaces of the toner cores is preferably at least 40° C. and no greater than 95° C., and more preferably at least 50° C. and no greater than 80° C.

Once the shell layers have been formed as described above, the aqueous dispersion containing the toner cores coated with the shell layers is cooled to room temperature to yield a dispersion of toner particles (toner mother particles).

Next, toner is collected from the toner particle dispersion through one or more steps selected as necessary from among washing of the toner particles (washing step), drying of the toner particles (drying step), and causing an external additive to adhere to the surfaces of the toner mother particles (external addition step).

In the washing step, the toner particles (toner mother particles) are washed using water. Examples of preferable washing methods include a method involving collecting a wet cake of the toner particles from the aqueous dispersion containing the toner particles through solid-liquid separation and washing the collected wet cake using water, and a method involving causing sedimentation of the toner particles in the dispersion containing the toner particles, substituting a supernatant with water, and re-dispersing the toner particles in the water after the substitution.

In the drying step, the toner particles (toner mother particles) are dried. One example of a preferable method for drying the toner particles involves using a dryer (for example, a spray dryer, a fluidized bed dryer, a vacuum freeze dryer, or a reduced pressure dryer). Among the above dryers, use of a spray dryer is preferable in terms of inhibiting aggregation of the toner particles during drying. In a situation in which a spray dryer is used, an external additive such as silica can be caused to adhere to the surfaces of the toner particles by spraying a dispersion of the external additive together with the dispersion of the toner particles.

In the external addition step, an external additive is caused to adhere to the surfaces of the toner particles (toner mother particles). One example of a preferable method for causing adhesion of an external additive involves mixing the toner particles and the external additive using a mixer (for example, an FM mixer or a Nauta mixer (registered Japanese trademark)) under conditions that ensure that the external additive does not become embedded in the surfaces of the toner particles.

As explained above, the electrostatic latent image developing toner according to the present disclosure has excellent high-temperature preservability and low-temperature fixability, and inhibits occurrence of offset at high temperatures. Therefore, the electrostatic latent image developing toner according to the present disclosure can be favorably used in various image forming apparatuses.

EXAMPLES

The following provides more specific explanation of the present disclosure through examples. Note that the present disclosure is not in any way limited by the following examples.

[Crystalline Polyester Resins A-F]

Crystalline polyester resins A-F having the physical properties shown in Table 1 were prepared.

TABLE 1

| | Crystalline polyester resin | | | | | |
|---|---|---|---|---|---|---|
| | A | B | C | D | E | F |
| Melting point ($Mp^c$) [° C.] | 80 | 90 | 120 | 75 | 125 | 100 |
| Crystallinity index | 1.05 | 1.06 | 1.09 | 1.01 | 1.07 | 1.05 |
| Mass average molecular weight (Mw) | 5,698 | 6,731 | 12,456 | 4,980 | 12,550 | 11,259 |
| Molecular weight distribution (Mw/Mn) | 6.5 | 5.1 | 4.7 | 5.7 | 4.2 | 4.5 |
| Acid value [mg KOH/g] | 6.2 | 20.3 | 4.6 | 1.8 | 9.7 | 4.6 |
| Hydroxyl value [mg KOH/g] | 40.5 | 36.5 | 20.1 | 28.9 | 48.3 | 33.6 |

[Amorphous Polyester Resins A-C]

Amorphous polyester resins A-C having the physical properties shown in Table 2 were prepared.

TABLE 2

| Amorphous polyester resin | A | B | C |
|---|---|---|---|
| Glass transition point (Tg) [° C.] | 60 | 55 | 70 |
| Crystallinity index | 2.03 | 2.45 | 2.14 |
| Mass average molecular weight (Mw) | 45,000 | 39,000 | 58,000 |
| Molecular weight distribution (Mw/Mn) | 30 | 25 | 35 |
| Acid value [mg KOH/g] | 6 | 14 | 5 |
| Hydroxyl value [mg KOH/g] | 18 | 30 | 14 |

The softening point (Tm) of each of the crystalline polyester resins and the amorphous polyester resins was measured using a capillary rheometer (CFT-500D produced by Shimadzu Corporation). A measurement sample (crystalline polyester resin or amorphous polyester resin) was set in the capillary rheometer and an S-shaped curve (S-shaped curve of stroke (mm)/temperature (° C.)) was obtained by causing melt-flow of 1 $cm^3$ of the sample under conditions of a die diameter of 1 mm, a plunger load of 20 $kg/cm^2$, and a heating rate of 6° C./minute. The softening point (Tm) was taken to be a temperature corresponding to a first shoulder part of the S-shaped curve.

The melting point ($Mp^c$) of each of the crystalline polyester resins was measured using a differential scanning calorimeter (DSC-6220 produced by Seiko Instruments Inc.). An aluminum pan containing 10 mg of the crystalline polyester resin was set in a measurement section of the differential scanning calorimeter. An empty aluminum pan was used as a reference. Heating was performed from 10° C. to 150° C. at a rate of 10° C./minute. The melting point ($Mp^c$) of the crystalline polyester resin was taken to be the temperature of a peak corresponding to a maximum of the heat of fusion on the heat absorption curve.

The softening points (Tm) and the melting points ($Mp^c$) of the crystalline polyester resins A-F and the amorphous polyester resins A-C measured according to the methods described above were used to calculate a crystallinity index ($Tm/Mp^c$) of each of the resins.

[Releasing Agents A-C]

The following releasing agents A-C were prepared.

Releasing agent A: Ester wax (WEP-3 produced by NOF Corporation, melting point ($Mp^r$) 75° C.)

Releasing agent B: Ester wax (WEP-2 produced by NOF Corporation, melting point ($Mp^r$) 60° C.)

Releasing agent C: Ester wax (WEP-8 produced by NOF Corporation, melting point ($Mp^r$) 80° C.)

The following thermoplastic components A-D were prepared.

Thermoplastic component A: Aqueous polyacrylamide (BECKAMINE (registered Japanese trademark) A-1 produced by DIC Corporation, 11% by mass solid concentration aqueous solution)

Thermoplastic component B: Acrylamide-based copolymer (monomer composition: 2-hydroxyethyl methacrylate/acrylamide/methacrylic acid-methyoxypolyethylene glycol=30/50/20 (molar ratio), 5% by mass solid concentration aqueous solution, glass transition point ($Tg^{nc}$) 110° C., mass average molecular weight 55,000)

Thermoplastic component C: Silicone-acrylic graft copolymer (SYMAC US-480 produced by Toagosei Co., Ltd., 25% by mass solid concentration aqueous solution)

Thermoplastic component D: Urethane resin aqueous solution (SUPERFLEX 170 produced by Daiichi Kogyo Seiyaku Co., Ltd., 30% by mass solid concentration aqueous solution)

Example 1

[Toner Core Preparation]

A mixer (FM mixer) was used to mix 22.5 parts by mass of crystalline polyester resin A and 67.5 parts by mass of amorphous polyester resin A as a binder resin, 5 parts by mass of a colorant (C.I. Pigment Blue 15:3, copper phthalocyanine), and 5 parts by mass of releasing agent A to yield a mixture.

Next, the resultant mixture was melt-kneaded using a two screw extruder (PCM-30 produced by Ikegai Corp.) to yield a melt-knead. The melt-knead was pulverized using a mechanical pulverizer (Turbo Mill produced by Freund-Turbo Corporation) to yield a pulverized product. The pulverized product was classified using a classifier (Elbow Jet produced by Nittetsu Mining Co., Ltd.) to yield toner cores having a volume median diameter ($D_{50}$) of 6.0 μm. The volume median diameter of the toner cores was measured using a Coulter Counter Multisizer 3 (produced by Beckman Coulter, Inc.). A sample of the toner cores was taken in order to measure triboelectric charge with a standard carrier and zeta potential in a pH 4 dispersion.

The toner cores used in preparation of a toner according to Example 1 had a triboelectric charge of −20 μC/g with the standard carrier and a zeta potential of −30 mV in the pH 4 dispersion. The triboelectric charge with the standard carrier and the zeta potential in the pH 4 dispersion were measured according to the following methods.

<Method of Measuring Triboelectric Charge with Standard Carrier>

A TURBULA mixer was used to mix a standard carrier N-01 (standard carrier for negative-charging toner) provided by The Imaging Society of Japan and 7% by mass of the toner cores relative to the standard carrier for 30 minutes. Using the resultant mixture as a measurement sample, a Q/m meter (MODEL 210HS-2A produced by Trek, Inc.) was used to measure the triboelectric charge of the toner cores upon frictional contact with the standard carrier. The triboelectric charge of the toner cores measured as described above indicates whether the toner cores tend to be charged to positive or negative polarity and indicates how readily the toner cores are charged.

<Method of Measuring Zeta Potential in pH 4 Dispersion>

A magnetic stirrer was used to stir 0.2 g of the toner cores and 20 g of a 1% concentration non-ionic surfactant (polyvinylpyrrolidone, K-85 produced by Nippon Shokubai Co.) dissolved in 80 g (mL) of ion exchanged water, and to uniformly disperse the toner cores in the solvent to yield a dispersion. Next, the dispersion was adjusted to pH 4 through addition of dilute hydrochloric acid to yield a pH 4 dispersion of the toner cores. Using the pH 4 dispersion of the toner cores as a measurement sample, a zeta potential and particle size distribution analyzer (Delsa Nano HC produced by Beckman Coulter, Inc.) was used to measure the zeta potential of the toner cores in the dispersion.

[Shell Layer Formation Process]

After 300 mL of ion exchanged water was added to a three-necked flask of 1 L capacity equipped with a thermometer and a stirring impeller, the internal temperature of the flask was maintained at 30° C. using a water bath. Next, the aqueous medium in the flask was adjusted to pH 4 through addition of dilute hydrochloric acid to the flask. After pH adjustment, 3.2 mL of an aqueous solution of hexamethylol melamine prepolymer (MIRBANE (registered Japanese trademark) resin SM-607 produced by Showa Denko K.K., solid concentration 80% by mass) and 0.8 mL of an aqueous solution of thermoplastic component A (11% solid concentration aqueous solution of aqueous polyacrylamide) were added to the flask as raw materials for the shell layers. The flask contents were subsequently stirred to dissolve the raw materials of the shell layers in the aqueous medium and yield an aqueous solution (A) of the raw materials of the shell layers.

Next, 300 g of the toner cores were added to the three-necked flask containing the aqueous solution (A) and the flask contents were stirred for 1 hour at a speed of 200 rpm. Next, 300 mL of ion exchanged water was added to the flask and the internal temperature of the flask was raised to 70° C. at a rate of 1° C./minute while stirring the flask contents at 100 rpm. Once the temperature had increased to 70° C., the flask contents were stirred for a further 2 hours at 100 rpm while maintaining the temperature at 70° C. Next, the flask contents were adjusted to pH 7 through addition of sodium hydroxide. The flask contents were subsequently cooled to room temperature to yield a dispersion containing toner mother particles.

[Washing Step]

A wet cake of the toner mother particles was collected from the toner mother particle-containing dispersion through filtration using a Buchner funnel. The toner mother particles were washed by re-dispersing the wet cake in ion exchanged water. Washing was repeated in the same manner five times.

A filtrate of the toner mother particle-containing dispersion and washings from the washing step were collected as effluent. The amount of the collected effluent was 97 parts by mass relative to 100 parts by mass of toner obtained after a drying step. The collected effluent had a total organic carbon (TOC) concentration of 8 mg/L. The total organic carbon concentration of the effluent was measured using a TOC analyzer (TOC-4200 produced by Shimadzu Corporation).

[Drying Step]

A slurry was prepared by dispersing the wet cake of the toner mother particles in aqueous ethanol solution (concentration 50% by mass). The resultant slurry was supplied into a continuous type surface modifier (Coatmizer (registered Japanese trademark) produced by Freund Corporation) in order to dry the toner mother particles in the slurry (drying conditions: hot air temperature 45° C., blower flow rate 2 $m^3$/minute).

[External Addition Step]

An FM mixer (produced by Nippon Coke & Engineering Co., Ltd.) having a capacity of 10 L was used to mix 100 parts by mass of the dried toner mother particles and 1.0 part by mass of silica (AEROSIL (registered Japanese trademark) REA90 produced by Nippon Aerosil Co., Ltd.) as an external additive for 5 minutes to cause the silica to adhere to the surfaces of the toner mother particles. Next, sifting was performed using a 200 mesh sieve (opening 75 μm) to yield the toner according to Example 1.

Examples 2 and 3

Toners according to Examples 2 and 3 were prepared according to substantially the same procedure as Example 1 in all aspects other than that the amount of the aqueous solution of the hexamethylol melamine prepolymer and the amount of thermoplastic component A (polyacrylamide aqueous solution) were changed as shown in Table 3.

Example 4

A toner according to Example 4 was prepared according to substantially the same procedure as Example 1 in all aspects other than that the 3.2 mL of the aqueous solution of the hexamethylol melamine prepolymer was changed to 4.0 mL of an aqueous solution of a glyoxal-based monomer (BECKAMINE (registered Japanese trademark) NS-11 produced by DIC Corporation, solid concentration 40% by mass), 2 mL of an aqueous solution of a composite metal catalyst (CATALIST GT-3 produced by DIC Corporation) was added with the aqueous solution of the glyoxal-based monomer, and the amount of thermoplastic component A was changed to 2 mL.

Example 5

A toner according to Example 5 was prepared according to substantially the same procedure as Example 1 in all aspects other than that the 3.2 mL of the aqueous solution of the hexamethylol melamine prepolymer was changed to 4 mL of an aqueous solution of methylol urea (BECKAMINE (registered Japanese trademark) J-300S produced by DIC Corporation, solid concentration 70% by mass), 2 mL of an aqueous solution of an organic amine catalyst (CATALIST 376 produced by DIC Corporation) was added with the aqueous solution of the methylol urea, and the amount of thermoplastic component A was changed to 2.0 mL.

Examples 6-8

Toners according to Examples 6-8 were prepared according to substantially the same procedure as Example 2 in all aspects other than that thermoplastic component A was changed to thermoplastic components B, C, and D respectively.

Examples 9 and 10

Toners according to Examples 9 and 10 were prepared according to substantially the same procedure as Example 1 in all aspects other than that the amount of the aqueous solution of the hexamethylol melamine prepolymer and the amount of thermoplastic component A (polyacrylamide aqueous solution) were changed as shown in Table 3.

Examples 11 and 12

Toners according to Examples 11 and 12 were prepared according to substantially the same procedure as Example 2 in all aspects other than that the type of crystalline polyester resin was changed as shown in Table 4. The toner cores used to prepare the toners according to Examples 11 and 12 had triboelectric charges with the standard carrier of −16 μC/g and −11 μC/g respectively and zeta potentials in a pH 4 dispersion of −21 mV and −15 mV respectively.

Examples 13 and 14

Toners according to Examples 13 and 14 were prepared according to substantially the same procedure as Example 2 in all aspects other than that the amounts of the crystalline polyester resin and the amorphous polyester resin were changed as shown in Table 4.

Examples 15 and 16

Toners according to Examples 15 and 16 were prepared according to substantially the same procedure as Example 2 in all aspects other than that the type of amorphous polyester resin was changed as shown in Table 4. The toner cores used to prepare the toners according to Examples 15 and 16 had triboelectric charges with the standard carrier of −15 μC/g and −19 μC/g respectively and zeta potentials in a pH 4 dispersion of −26 mV and −28 mV respectively.

Examples 17 and 18

Toners according to Examples 17 and 18 were prepared according to substantially the same procedure as Example 2 in all aspects other than that the type of releasing agent was changed as shown in Table 4. The toner cores used to prepare the toners according to Examples 17 and 18 had triboelectric charges with the standard carrier of −15 μC/g and −19 μC/g respectively and zeta potentials in a pH 4 dispersion of −26 mV and −28 mV respectively.

Comparative Example 1

A toner according to Comparative Example 1 was prepared according to substantially the same procedure as Example 1 in all aspects other than that the amount of the aqueous solution of the hexamethylol melamine prepolymer was changed to 4.0 mL, and an aqueous solution of a thermoplastic component was not used.

Comparative Example 2

A toner according to Comparative Example 2 was prepared according to substantially the same procedure as Example 1 in all aspects other than that an aqueous solution of a hexamethylol melamine prepolymer was not used, and the amount of the aqueous solution of thermoplastic component A was changed to 4.0 mL.

Comparative Examples 3-5

Toners according to Comparative Examples 3-5 were prepared according to substantially the same procedure as Example 2 in all aspects other than that the type of crystalline polyester resin was changed as shown in Table 5. The toner cores used to prepare the toners according to Comparative Examples 3-5 had triboelectric charges with the standard carrier of −37 μC/g, −14 μC/g, and −18 μC/g respectively and zeta potentials in a pH 4 dispersion of −41 mV, −25 mV, and −28 mV respectively.

Comparative Example 6

Toner cores were used as toner mother particles without performing a shell formation process. A toner according to Comparative Example 6 was prepared by subjecting the toner mother particles to external addition according to substantially the same procedure as Example 1.

Comparative Example 7

A toner according to Comparative Example 7 was prepared according to substantially the same procedure as Example 2 in all aspects other than that a crystalline polyester resin was not used as the binder resin. The toner cores used in preparation of the toner according to Example 7 had a triboelectric charge of −50 μC/g with the standard carrier and a zeta potential of −65 mV in a pH 4 dispersion.

The following explains methods by which the toners according to Examples 1-18 and Comparative Examples 1-7 were measured and evaluated.

(1) Presence of Glass Transition Point (Tg) in Second Run

An aluminum pan containing 10 mg of toner was set in a measurement section of a differential scanning calorimeter (DSC-6220 produced by Seiko Instruments Inc.). A first run was performed starting from a measurement temperature of 10° C. and heating to 150° C. at a rate of 10° C./minute. After the first run, cooling was performed to 10° C. at a rate of 10° C./minute. Next, a second run was performed by reheating to 150° C. at a rate of 10° C./minute. A heat absorption curve of the second run was inspected for presence of a glass transition point of the toner that was observed in a heat absorption curve of the first run.

(2) Shell Layer Thickness

Cross-sectional TEM photographs of toner particles included in the toners according to Examples 1-18 and Comparative Examples 1-5 and 7 were recorded according to the following method. Note that shell layer thickness of the toner according to Comparative Example 6 could not be measured because the shell layer formation process was not performed. The shell layer thickness was calculated from the cross-sectional TEM photographs of the toner particles according to the following method.

<Method of Recording Cross-Sectional TEM Photographs of Toner Particles>

First, the toner was dispersed in cold-setting epoxy resin and left to stand for 2 days at an ambient temperature of 40° C. to yield a hardened material. The hardened material was dyed using osmium tetroxide. Next, a flake sample of 200 nm in thickness for observation of toner particle cross-sections was cut from the resultant hardened material using a microtome (EM UC6 produced by Leica Microsystems). The resultant sample was observed using a transmission electron microscope (TEM, JSM-6700F produced by JEOL Ltd.) at magnifications of ×3,000 and ×10,000, and TEM photographs of toner particle cross-sections were recorded.

(3) High-Temperature Preservability

High-temperature preservability of the toners according to Examples 1-18 and Comparative Examples 1-7 was evaluated according to the following method.

Toner for high-temperature preservability evaluation was obtained by weighing 2 g of toner into a plastic container having a capacity of 20 mL and leaving the toner to stand for 3 hours in a thermostatic chamber set to 60° C. Next, the toner for high-temperature preservability evaluation was sifted in accordance with a manual of a powder tester (produced by Hosokawa Micron Corporation) under conditions of a rheostat level of 5 and a time of 30 seconds, using a 200 mesh sieve (opening 75 μm). The mass of toner remaining on the sieve after sifting was measured. The degree of aggregation (%) was calculated according to the following equation from the mass of the toner prior to sifting and the mass of the toner remaining on the sieve after sifting. High-temperature preservability was evaluated from the calculated degree of aggregation based on the following standard. An evaluation of "Good" was considered to pass the evaluation, Degree of aggregation (%)=(mass of toner remaining on sieve/mass of toner prior to sifting)×100

Good: Degree of aggregation of no greater than 30%

Poor: Degree of aggregation of greater than 30%

[Preparation of Two Component Developer]

Low-temperature fixability and high-temperature offset resistance of the toners according to Examples 1-18 and Comparative Examples 1-7 were evaluated according to the following methods. Evaluation of low-temperature fixability and high-temperature offset resistance was performed using the toners according to Examples 1-18 and Comparative Examples 1-7, and two component developers prepared according to the following method.

A two component developer for evaluation was prepared by using a ball mill to mix a developer carrier (carrier for TASKalfa5550ci produced by KYOCERA Document Solutions Inc.) and 10% by mass of toner (toner according to a corresponding one of Examples 1-18 and Comparative Examples 1-7) relative to the mass of the carrier for 30 minutes.

(4) Low-Temperature Fixability

A printer (FS-05250DN produced by KYOCERA Document Solutions Inc.) modified in order to enable adjustment of fixing temperature was used as an evaluation apparatus. A two component developer prepared as described above was loaded into a development section of the evaluation apparatus and a toner corresponding to the two component developer was loaded into a toner container of the evaluation apparatus. The evaluation apparatus was used to form an unfixed solid image on a recording medium with settings of a linear speed of 200 mm/s and a toner application amount of 1.0 mg/cm$^2$. The unfixed solid image was fixed in a fixing temperature range from 100° C. to 200° C. by increasing the fixing temperature of the evaluation apparatus from 100° C. in increments of 5° C. The recording medium having the solid image fixed thereto was folded in half with a surface on which the image was formed facing inward and a 1 kg weight covered with cloth was rubbed back and forth on the fold five times. Next, the recording medium was opened out. An evaluation of "Pass" was given when peeling of the toner of a fold portion was no greater than 1 mm and an evaluation of "Fail" was given when peeling was greater than 1 mm. A lowest of the fixing temperatures at which the peeling of the toner was judged to "Pass" was taken to be a minimum fixing temperature. Low-temperature fixability was evaluated in accordance with the following standard.

Pass: Minimum fixing temperature of no greater than 135° C.

Fail: Minimum fixing temperature of greater than 135° C.

(5) High-Temperature Offset Resistance

An unfixed solid image was formed on a recording medium using the same evaluation apparatus, recording medium, and conditions as in evaluation of low-temperature fixability. The fixing temperature of a fixing device of the evaluation apparatus was increased from 170° C. in increments of 10° C. and a lowest temperature at which offset occurred (first offset occurrence temperature) was determined by checking occurrence of offset for each of the 10° C. increments. Next, the fixing temperature of the fixing device of the evaluation apparatus was increased from a temperature 10° C. lower than the first offset occurrence temperature in increments of 1° C. and a lowest temperature at which offset occurred was determined by checking occurrence of offset for each of the 1° C. increments. The lowest temperature at which offset occurred while increasing the fixing temperature of the fixing device of the evaluation apparatus in 1° C. increments was taken to be an offset occurrence temperature. High-temperature offset resistance was evaluated in accordance with the following standard.

Good: Offset occurrence temperature of at least 210° C.

Poor: Offset occurrence temperature of less than 210° C.

Evaluation results for the toners according to Examples 1-18 and Comparative Examples 1-7 are shown in Tables 3-5. Note that "P/Q" in Tables 3-5 indicates a ratio (mass ratio) of the amount P of the crystalline polyester resin relative to the amount Q of the amorphous polyester resin. Furthermore, "-" in Table 5 indicates that the corresponding material was not added.

TABLE 3

| | | | Example 1 | Example 2 | Example 3 | Example 4 | Example 5 | Example 6 | Example 7 | Example 8 | Example 9 | Example 10 |
|---|---|---|---|---|---|---|---|---|---|---|---|---|
| Toner cores | Crystalline polyester resin | Type | A | A | A | A | A | A | A | A | A | A |
| | | Melting point ($Mp^c$) [° C.] | 80 | 80 | 80 | 80 | 80 | 80 | 80 | 80 | 80 | 80 |
| | | Crystallinity index | 1.05 | 1.05 | 1.05 | 1.05 | 1.05 | 1.05 | 1.05 | 1.05 | 1.05 | 1.05 |
| | | Mass average molecular weight (Mw) | 5,698 | 5,698 | 5,698 | 5,698 | 5,698 | 5,698 | 5,698 | 5,698 | 5,698 | 5,698 |
| | | Molecular weight distribution (Mw/Mn) | 6.5 | 6.5 | 6.5 | 6.5 | 6.5 | 6.5 | 6.5 | 6.5 | 6.5 | 6.5 |
| | | Acid value [mg KOH/g] | 6.2 | 6.2 | 6.2 | 6.2 | 6.2 | 6.2 | 6.2 | 6.2 | 6.2 | 6.2 |
| | | Hydroxyl value [mg KOH/g] | 40.5 | 40.5 | 40.5 | 40.5 | 40.5 | 40.5 | 40.5 | 40.5 | 40.5 | 40.5 |
| | | Amount [parts by mass] | 20 | 20 | 20 | 20 | 20 | 20 | 20 | 20 | 20 | 20 |
| | Amorphous polyester resin | Type | A | A | A | A | A | A | A | A | A | A |
| | | Glass transition point (Tg) [° C.] | 60 | 60 | 60 | 60 | 60 | 60 | 60 | 60 | 60 | 60 |
| | | Crystallinity index | 2.03 | 2.03 | 2.03 | 2.03 | 2.03 | 2.03 | 2.03 | 2.03 | 2.03 | 2.03 |
| | | Mass average molecular weight (Mw) | 45,000 | 45,000 | 45,000 | 45,000 | 45,000 | 45,000 | 45,000 | 45,000 | 45,000 | 45,000 |
| | | Molecular weight distribution (Mw/Mn) | 30 | 30 | 30 | 30 | 30 | 30 | 30 | 30 | 30 | 30 |
| | | Acid value [mg KOH/g] | 6 | 6 | 6 | 6 | 6 | 6 | 6 | 6 | 6 | 6 |
| | | Hydroxyl value [mg KOH/g] | 18 | 18 | 18 | 18 | 18 | 18 | 18 | 18 | 18 | 18 |
| | | Amount [parts by mass] | 80 | 80 | 80 | 80 | 80 | 80 | 80 | 80 | 80 | 80 |
| | Relationship of crystalline polyester resin and amorphous polyester resin | P/Q | 0.33 | 0.33 | 0.33 | 0.33 | 0.33 | 0.33 | 0.33 | 0.33 | 0.33 | 0.33 |
| | Releasing agent | Type | A | A | A | A | A | A | A | A | A | A |
| | | $Mp^r$ [° C.] | 75 | 75 | 75 | 75 | 75 | 75 | 75 | 75 | 75 | 75 |
| Shell layers | Thermosetting component | Monomer type | Methylol melamine | Methylol melamine | Methylol melamine | Glyoxal-based monomer | Methylol urea | Methylol melamine | Methylol melamine | Methylol melamine | Methylol melamine | Methylol melamine |
| | | Amount [mL] | 3.2 | 2.0 | 1.2 | 4.0 | 4.0 | 2.0 | 2.0 | 2.0 | 0.4 | 8.0 |
| | Thermoplastic component | Type | A | A | A | A | A | B | C | D | A | A |
| | | Amount [mL] | 0.8 | 2.0 | 2.8 | 2.0 | 2.0 | 2.0 | 2.0 | 2.0 | 0.4 | 8.0 |
| | | Shell layer thickness [nm] | 10 | 10 | 10 | 10 | 10 | 10 | 10 | 10 | 1 | 20 |
| Toner | | Presence of glass transition point in second DSC run | No | No | No | No | No | No | No | No | No | No |
| Evaluation | High-temperature preservability | Degree of aggregation [%] | 8 | 14 | 21 | 16 | 20 | 8 | 4 | 15 | 28 | 4 |
| | | Evaluation result | Good | Good | Good | Good | Good | Good | Good | Good | Good | Good |
| | Low-temperature fixability | Minimum fixing temperature [° C.] | 120 | 115 | 110 | 110 | 110 | 110 | 115 | 110 | 105 | 135 |
| | | Evaluation result | Pass | Pass | Pass | Pass | Pass | Pass | Pass | Pass | Pass | Pass |
| | High temperature offset resistance | Offset occurrence temperature [° C.] | 225 | 220 | 215 | 210 | 210 | 220 | 230 | 215 | 210 | 240 |
| | | Evaluation result | Good | Good | Good | Good | Good | Good | Good | Good | Good | Good |

TABLE 4

| | | | Example 11 | Example 12 | Example 13 | Example 14 | Example 15 | Example 16 | Example 17 | Example 18 |
|---|---|---|---|---|---|---|---|---|---|---|
| Toner cores | Crystalline polyester resin | Type | B | C | A | A | A | A | A | A |
| | | Melting point ($Mp^c$) [° C.] | 90 | 120 | 80 | 80 | 80 | 80 | 80 | 80 |
| | | Crystallinity index | 1.06 | 1.09 | 1.05 | 1.05 | 1.05 | 1.05 | 1.05 | 1.05 |
| | | Mass average molecular weight (Mw) | 6,731 | 12,456 | 5,698 | 5,698 | 5,698 | 5,698 | 5,698 | 5,698 |
| | | Molecular weight distribution (Mw/Mn) | 5.1 | 4.7 | 6.5 | 6.5 | 6.5 | 6.5 | 6.5 | 6.5 |
| | | Acid value [mg KOH/g] | 20.3 | 4.6 | 6.2 | 6.2 | 6.2 | 6.2 | 6.2 | 6.2 |
| | | Hydroxyl value [mg KOH/g] | 36.5 | 20.1 | 40.5 | 40.5 | 40.5 | 40.5 | 40.5 | 40.5 |
| | | Amount [parts by mass] | 20 | 20 | 5 | 50 | 20 | 20 | 20 | 20 |
| | Amorphous polyester resin | Type | A | A | A | A | B | C | A | A |
| | | Glass transition point (Tg) [° C.] | 60 | 60 | 60 | 60 | 55 | 70 | 60 | 60 |
| | | Crystallinity index | 2.03 | 2.03 | 2.03 | 2.03 | 2.45 | 2.14 | 2.03 | 2.03 |
| | | Mass average molecular weight (Mw) | 45,000 | 45,000 | 45,000 | 45,000 | 39,000 | 58,000 | 45,000 | 45,000 |
| | | Molecular weight distribution (Mw/Mn) | 30 | 30 | 30 | 30 | 25 | 35 | 30 | 30 |
| | | Acid value [mg KOH/g] | 6 | 6 | 6 | 6 | 14 | 5 | 6 | 6 |
| | | Hydroxyl value [mg KOH/g] | 18 | 18 | 18 | 18 | 30 | 14 | 18 | 18 |
| | | Amount [parts by mass] | 80 | 80 | 95 | 50 | 80 | 80 | 80 | 80 |
| | Relationship of crystalline polyester resin and amorphous polyester resin | P/Q | 0.33 | 0.33 | 0.01 | 1.00 | 0.33 | 0.33 | 0.33 | 0.33 |
| | Releasing agent | Type | A | A | A | A | A | A | B | C |
| | | $Mp^r$ [° C.] | 75 | 75 | 75 | 75 | 75 | 75 | 60 | 80 |
| Shell layers | Thermosetting component | Monomer type | Methylol melamine | Methylol melamine | Methylol melamine | Methylol melamine | Methylol melamine | Methylol melamine | Methylol melamine | Methylol melamine |
| | | Amount [mL] | 2 | 2 | 2 | 2 | 2 | 2 | 2 | 2 |
| | Thermoplastic component | Type | A | A | A | A | A | A | A | A |
| | | Amount [mL] | 2.0 | 2.0 | 2.0 | 2.0 | 2.0 | 2.0 | 2.0 | 2.0 |
| | Shell layer thickness [nm] | | 10 | 10 | 10 | 10 | 10 | 10 | 10 | 10 |
| Toner | Presence of glass transition point in second DSC run | | No | No | No | No | No | No | No | No |
| Evaluation | High-temperature preservability | Degree of aggregation [%] | 24 | 15 | 2 | 30 | 28 | 4 | 9 | 7 |
| | | Evaluation result | Good | Good | Good | Good | Good | Good | Good | Good |
| | Low-temperature fixability | Minimum fixing temperature [° C.] | 105 | 130 | 135 | 95 | 105 | 130 | 120 | 120 |
| | | Evaluation result | Pass | Pass | Pass | Pass | Pass | Pass | Pass | Pass |
| | High-temperature offset resistance | Offset occurrence temperature [° C.] | 220 | 235 | 240 | 210 | 215 | 235 | 225 | 230 |
| | | Evaluation result | Good | Good | Good | Good | Good | Good | Good | Good |

TABLE 5

| | | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|
| Toner cores | Crystalline polyester resin | Type | A | A | D | E | F | A | — |
| | | Melting point ($Mp^c$) [° C.] | 80 | 80 | 75 | 125 | 100 | 80 | — |
| | | Crystallinity index | 1.05 | 1.05 | 1.01 | 1.07 | 1.05 | 1.05 | — |
| | | Mass average molecular weight (Mw) | 5,698 | 5,698 | 4,980 | 12,550 | 11,259 | 5,698 | — |
| | | Molecular weight distribution (Mw/Mn) | 6.5 | 6.5 | 5.7 | 4.2 | 4.5 | 6.5 | — |
| | | Acid value [mg KOH/g] | 6.2 | 6.2 | 1.8 | 9.7 | 4.6 | 6.2 | — |
| | | Hydroxyl value [mg KOH/g] | 40.5 | 40.5 | 28.9 | 48.3 | 33.6 | 40.5 | — |
| | | Amount [parts by mass] | 20 | 20 | 20 | 20 | 20 | 20 | — |
| | Amorphous polyester resin | Type | A | A | A | A | A | A | A |
| | | Glass transition point (Tg) [° C.] | 60 | 60 | 60 | 60 | 60 | 60 | 60 |
| | | Crystallinity index | 2.03 | 2.03 | 2.03 | 2.03 | 2.03 | 2.03 | 2.03 |
| | | Mass average molecular weight (Mw) | 45,000 | 45,000 | 45,000 | 45,000 | 45,000 | 45,000 | 45,000 |
| | | Molecular weight distribution (Mw/Mn) | 30 | 30 | 30 | 30 | 30 | 30 | 30 |

TABLE 5-continued

| | | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|
| | | Acid value [mg KOH/g] | 6 | 6 | 6 | 6 | 6 | 6 | 6 |
| | | Hydroxyl value [mg KOH/g] | 18 | 18 | 18 | 18 | 18 | 18 | 18 |
| | | Amount [parts by mass] | 80 | 80 | 80 | 80 | 80 | 80 | 100 |
| | Relationship of crystalline polyester resin and amorphous polyester resin | P/Q | 0.33 | 0.33 | 0.33 | 0.33 | 0.33 | 0.33 | — |
| | Releasing agent | Type | A | A | A | A | A | A | A |
| | | $Mp^r$ [° C.] | 75 | 75 | 75 | 75 | 75 | 75 | 75 |
| Shell layers | Thermosetting component | Monomer type | Methylol melamine | — | Methylol melamine | Methylol melamine | Methylol melamine | — | Methylol melamine |
| | | Amount [mL] | 4.0 | — | 2.0 | 2.0 | 2.0 | — | 2.0 |
| | Thermoplastic component | Type | — | A | A | A | A | — | A |
| | | Amount [mL] | — | 4.0 | 2.0 | 2.0 | 2.0 | — | 2.0 |
| | Shell layer thickness [nm] | | 10 | 10 | 10 | 10 | 10 | — | 10 |
| Toner | Presence of glass transition point in second DSC run | | No | No | No | No | Yes | No | — |
| Evaluation | High-temperature preservability | Degree of aggregation [%] | 4 | 90 | 35 | 6 | 4 | 99 | 6 |
| | | Evaluation result | Good | Poor | Poor | Good | Good | Poor | Good |
| | Low-temperature fixability | Minimum fixing temperature [° C.] | 140 | 115 | 115 | 140 | 140 | 90 | 175 |
| | | Evaluation result | Fail | Pass | Pass | Fail | Fail | Pass | Fail |
| | High-temperature offset resistance | Offset occurrence temperature [° C.] | 235 | 210 | 200 | 230 | 230 | 180 | 245 |
| | | Evaluation result | Good | Good | Poor | Good | Good | Poor | Good |

Examples 1-18 clearly demonstrate that the toner according to the present embodiment has excellent high-temperature preservability and low-temperature fixability, and also inhibits occurrence of offset at high temperatures.

Comparative Example 1 demonstrates that in a situation in which a toner includes toner particles in which shell layers are formed by a resin that does not include a thermoplastic component, the toner has poor low-temperature fixability. The reason for the poor low-temperature fixability is thought to be as follows. A resin including a thermosetting component and a thermoplastic component is flexible due to the thermoplastic component. In contrast, shell layers that contain only a thermosetting component are too hard due to there being a high degree of cross-linking. Therefore, the toner according to Comparative Example 1 tends to be difficult to fix because the shell layers do not readily rupture upon application of heat and temperature to the toner particles during fixing.

Comparative Example 2 demonstrates that in a situation in which a toner includes toner particles in which shell layers are formed by a resin that does not include a thermosetting component, the toner has poor high-temperature preservability. The reason for the poor high-temperature preservability is thought to be as follows. In a situation in which a resin contained in shell layers only includes a thermoplastic component, cross-linking does not occur between molecules of the thermoplastic component. Therefore, the toner particles included in the toner according to Comparative Example 2 do not include shell layers in a desired state. Consequently, in Comparative Example 2, components such as the releasing agent contained in the toner cores tend to readily exude to the surfaces of the toner particles, leading to poor high-temperature preservability.

Comparative Example 3 demonstrates that in a situation in which a toner includes toner particles prepared using toner cores containing, as a binder resin, a crystalline polyester resin having a melting point ($Mp^c$) that is too low, the toner has poor high-temperature preservability and tends not to inhibit occurrence of offset at high temperatures. The reason for the above is thought to be that the toner particles in the toner according to Comparative Example 3 tend to readily deform at high temperatures.

Comparative Example 4 demonstrates that in a situation in which a toner includes toner particles prepared using toner cores containing, as a binder resin, a crystalline polyester resin having a melting point ($Mp^c$) that is too high, the toner has poor low-temperature fixability.

Comparative Example 5 is thought to demonstrate that crystallization leads to poorer low-temperature fixability based on the fact that a toner is judged to have a high degree of crystallinity if a glass transition point of the toner is observed in a heat absorption curve of a second run.

Comparative Example 6 demonstrates that in a situation in which a toner includes toner particles for which shell layers are not formed, the toner has poor high-temperature preservability and tends not to inhibit occurrence of offset at high temperatures. The reason for the above is thought to be that components such as the releasing agent tend to readily exude to the surfaces of the toner particles of the toner according to Comparative Example 6 because the toner particles do not include shell layers.

Comparative Example 7 demonstrates that in a situation in which a toner includes toner particles prepared using toner cores that do not contain a crystalline polyester resin as a binder resin, the toner has poor low-temperature fixability.

What is claimed is:

1. An electrostatic latent image developing toner comprising toner particles that each include a toner core containing a binder resin and a shell layer disposed over a surface of the toner core, wherein the binder resin includes a crystalline polyester resin and an amorphous polyester resin, the crystalline polyester resin has a melting point of at least 80° C. and no greater than 120° C., when the electrostatic latent image developing toner is measured using a differential scanning calorimeter, a glass transition point is observed in a first run but is not observed in a second run, and the shell layer contains a resin including a thermosetting component and a thermoplastic component, the crystalline polyester resin has a molecular weight distribution (Mw/Mn) of at least 4.7 and no greater than 6.5, the molecular weight distribution (Mw/Mn) of the crystalline polyester resin expressing a ratio of a mass average molecular weight (Mw) of the crystalline polyester resin relative to a number average molecular weight (Mn) of the crystalline polyester resin.

2. The electrostatic latent image developing toner according to claim 1, wherein the thermosetting component is at least one resin component selected from the group consisting of a melamine resin, a urea resin, and a glyoxal resin.

3. The electrostatic latent image developing toner according to claim 1, wherein the toner core has a negative zeta potential as measured in an aqueous toner core dispersion adjusted to pH 4.

4. The electrostatic latent image developing toner according to claim 1, wherein the thermoplastic component includes a unit derived from (meth)acryl amide.

5. The electrostatic latent image developing toner according to claim 1, wherein a content P of the crystalline polyester resin and a content Q of the amorphous polyester resin in the binder resin have a mass ratio P/Q of at least 0.01 and no greater than 1.

6. The electrostatic latent image developing toner according to claim 1, wherein the amorphous polyester resin has a mass average molecular weight Mw of at least 39,000 and no greater than 58,000, and a molecular weight distribution Mw/Mn of the amorphous polyester resin expressing a ratio of the mass average molecular weight Mw of the amorphous polyester resin and a number average molecular weight Mn of the amorphous polyester resin is at least 8 and no greater than 50.

7. The electrostatic latent image developing toner according to claim 1, wherein the amorphous polyester resin has an acid value of at least 5 mg KOH/g and no greater than 30 mg KOH/g, and the amorphous polyester resin has a hydroxyl value of at least 15 mg KOH/g and no greater than 80 mg KOH/g.

8. The electrostatic latent image developing toner according to claim 1, wherein the toner core contains an ester wax as a releasing agent, and the releasing agent has a melting point of at least 60° C. and no greater than 80° C.

9. The electrostatic latent image developing toner according to claim 1, wherein the shell layer has a thickness of at least 1 nm and no greater than 20 nm.

10. The electrostatic latent image developing toner according to claim 1, wherein the amorphous polyester resin has a glass transition point of at least 50° C. and no greater than 70° C.

11. The electrostatic latent image developing toner according to claim 1, wherein the crystalline polyester resin has a crystallinity index of at least 1.05 and no greater than 1.09.

12. The electrostatic latent image developing toner according to claim 1, wherein the crystalline polyester resin has the mass average molecular weight (Mw) of at least 5698 and no greater than 12456.

13. The electrostatic latent image developing toner according to claim 1, wherein the crystalline polyester resin has an acid value of at least 4.6 mg KOH/g and no greater than 20.3 mg KOH/g.

14. The electrostatic latent image developing toner according to claim 1, wherein the crystalline polyester resin has a hydroxyl value of at least 20.1 mg KOH/g and no greater than 40.5 mg KOH/g.

15. The electrostatic latent image developing toner according to claim 1, wherein the amorphous polyester resin has a glass transition point of at least 55° C. and no greater than 70° C.

16. The electrostatic latent image developing toner according to claim 1, wherein the amorphous polyester resin has a crystallinity index of at least 2.03 and no greater than 2.45.

17. The electrostatic latent image developing toner according to claim 1, wherein the amorphous polyester resin has a molecular weight distribution (Mw/Mn) of at least 25 and no greater than 35, the molecular weight distribution (Mw/Mn) of the amorphous polyester resin expressing a ratio of a mass average molecular weight (Mw) of the amorphous polyester resin relative to a number average molecular weight (Mn) of the amorphous polyester resin.

18. The electrostatic latent image developing toner according to claim 1, wherein the amorphous polyester resin has an acid value of at least 5 mg KOH/g and no greater than 14 mg KOH/g.

19. The electrostatic latent image developing toner according to claim 1, wherein the amorphous polyester resin has a hydroxyl value of at least 14 mg KOH/g and no greater than 30 mg KOH/g.

* * * * *